United States Patent [19]

Tsuji

[11] Patent Number: 5,020,642

[45] Date of Patent: Jun. 4, 1991

[54] GROUP-SUPERVISORY APPARATUS FOR ELEVATOR SYSTEM

[75] Inventor: Shintaro Tsuji, Inazawa, Japan

[73] Assignee: Mitsubishi Denki Kabushiki Kaisha, Japan

[21] Appl. No.: 310,310

[22] Filed: Feb. 14, 1989

[30] Foreign Application Priority Data

Feb. 17, 1988 [JP] Japan ..... 63-34317

[51] Int. Cl.[5] ..... B66B 1/20

[52] U.S. Cl. ..... 187/124; 187/127

[58] Field of Search ..... 187/124, 125, 128, 130, 187/127; 364/148, 424.01

[56] References Cited

U.S. PATENT DOCUMENTS

| | | | |
|---|---|---|---|
| 4,846,311 | 7/1989 | Thangavelu | 187/128 |
| 4,860,207 | 8/1989 | Kubo | 187/124 |
| 4,875,554 | 10/1989 | MacDonald et al. | 187/124 |
| 4,901,822 | 2/1990 | Tsuji | 187/125 |

FOREIGN PATENT DOCUMENTS

| | | |
|---|---|---|
| 55-32625 | 8/1980 | Japan . |
| 62-56076 | 11/1987 | Japan . |

*Primary Examiner*—M. H. Paschall

*Attorney, Agent, or Firm*—Leydig, Voit & Mayer

[57] ABSTRACT

A group-supervisory apparatus for an elevator system includes an apparatus which registers hall calls when hall buttons are depressed, selects a cage to serve from among a plurality of cages and assigns it to the hall call, performs operation controls such as determining a traveling direction of the cage, starting and stopping the cage, and opening and closing a door of the cage, thereby causing the cage to respond to a cage call and the allotted hall call, and causes the cage to stand by at a floor at which it has responded to the last call or to travel to and stand by at a predetermined floor. The apparatus predictively calculates cage positions and cage directions after the respective cages have successively responded to the cage calls and the allotted hall calls since the current time and a predetermined time has lapsed. Also, it predictively calculates the presence or absence or the number of the cages which will lie at predetermined floors or in predetermined floor zones after the lapse of the predetermined time, on the basis of the predicted cage positions and the predicted cage directions. At least one of the functions of selecting a cage, performing operation controls, and causing the cage to stand by is performed using the predicted number of the cages.

18 Claims, 9 Drawing Sheets

GR SUPERV PROM(10)
START
INPUT PROM
31
HALL CALL REG PROM
32
33
33A
33X
ARR EXPECT TIME CALC PROM
33B
CAGE POS PREDICT PROM
33C
CAGE NUM PREDICT PROM
ASSIGNMENT LIMIT PROM
33D
WAIT TIME EST PROM
33E
36
TENTATIVE ASSIGNMENT EST PROM
WITH CAGE #4 ASSIGNED TENTATIVEL
ASSIGNED CAGE SEL PROM
37
STAND-BY OPR PROM
38
OUTPUT PROM
39

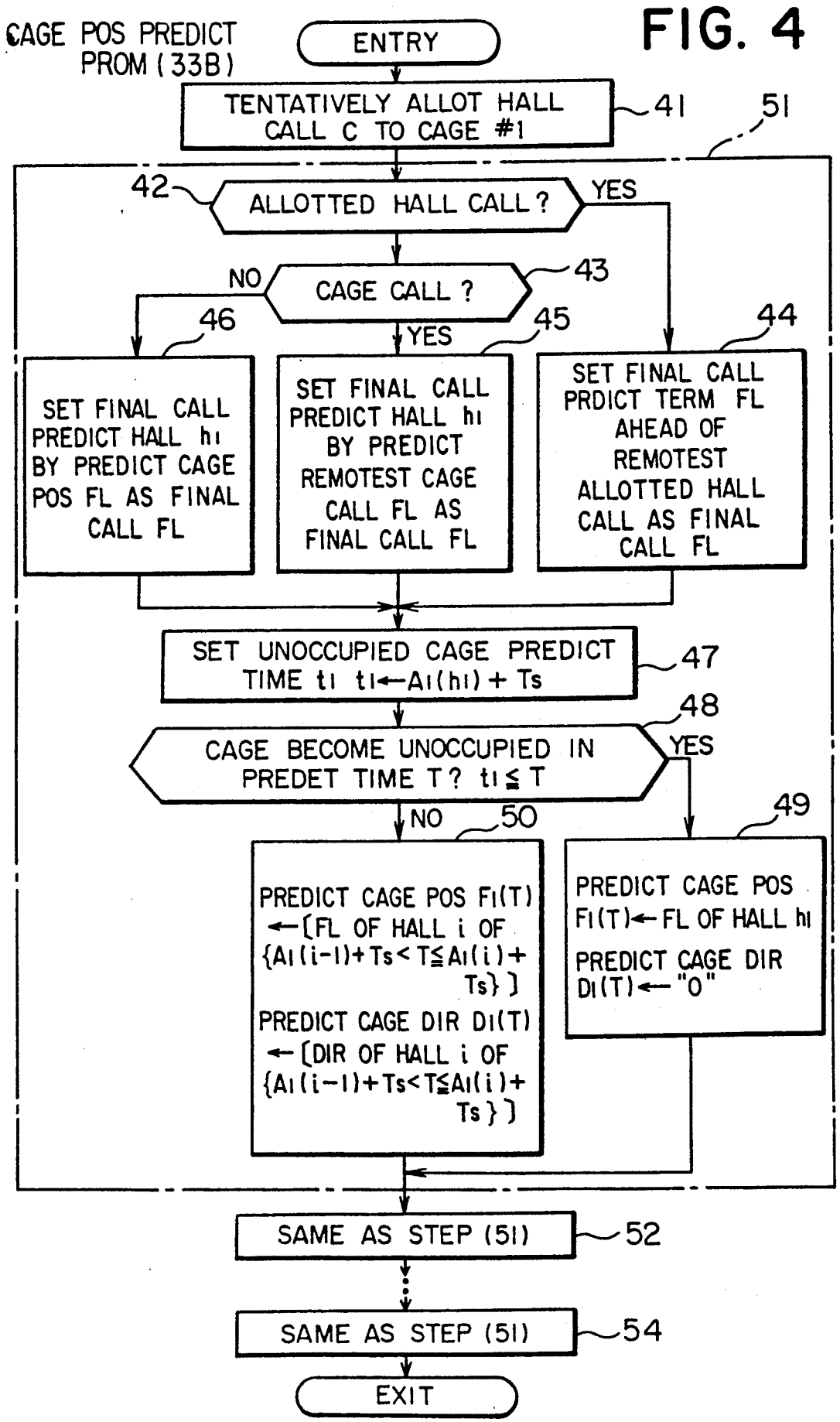
FIG. 4
CAGE POS PREDICT PROM (33B)
ENTRY
TENTATIVELY ALLOT HALL CALL C TO CAGE #1
41
51
42
ALLOTTED HALL CALL ?
YES
NO
CAGE CALL ?
43
46
YES
45
44
SET FINAL CALL PREDICT HALL hi BY PREDICT CAGE POS FL AS FINAL CALL FL
SET FINAL CALL PREDICT HALL hi BY PREDICT REMOTEST CAGE CALL FL AS FINAL CALL FL
SET FINAL CALL PRDICT TERM FL AHEAD OF REMOTEST ALLOTTED HALL CALL AS FINAL CALL FL
SET UNOCCUPIED CAGE PREDICT TIME ti ti←Ai(hi) + Ts
47
48
CAGE BECOME UNOCCUPIED IN PREDET TIME T? ti ≦ T
YES
NO
50
49
PREDICT CAGE POS Fi(T) ←[FL OF HALL i OF {Ai(i-1)+Ts<T≦Ai(i)+Ts}]
PREDICT CAGE DIR Di(T) ←[DIR OF HALL i OF {Ai(i-1)+Ts<T≦Ai(i)+Ts}]
PREDICT CAGE POS Fi(T)←FL OF HALL hi
PREDICT CAGE DIR Di(T)←"0"
SAME AS STEP (51)
52
SAME AS STEP (51)
54
EXIT

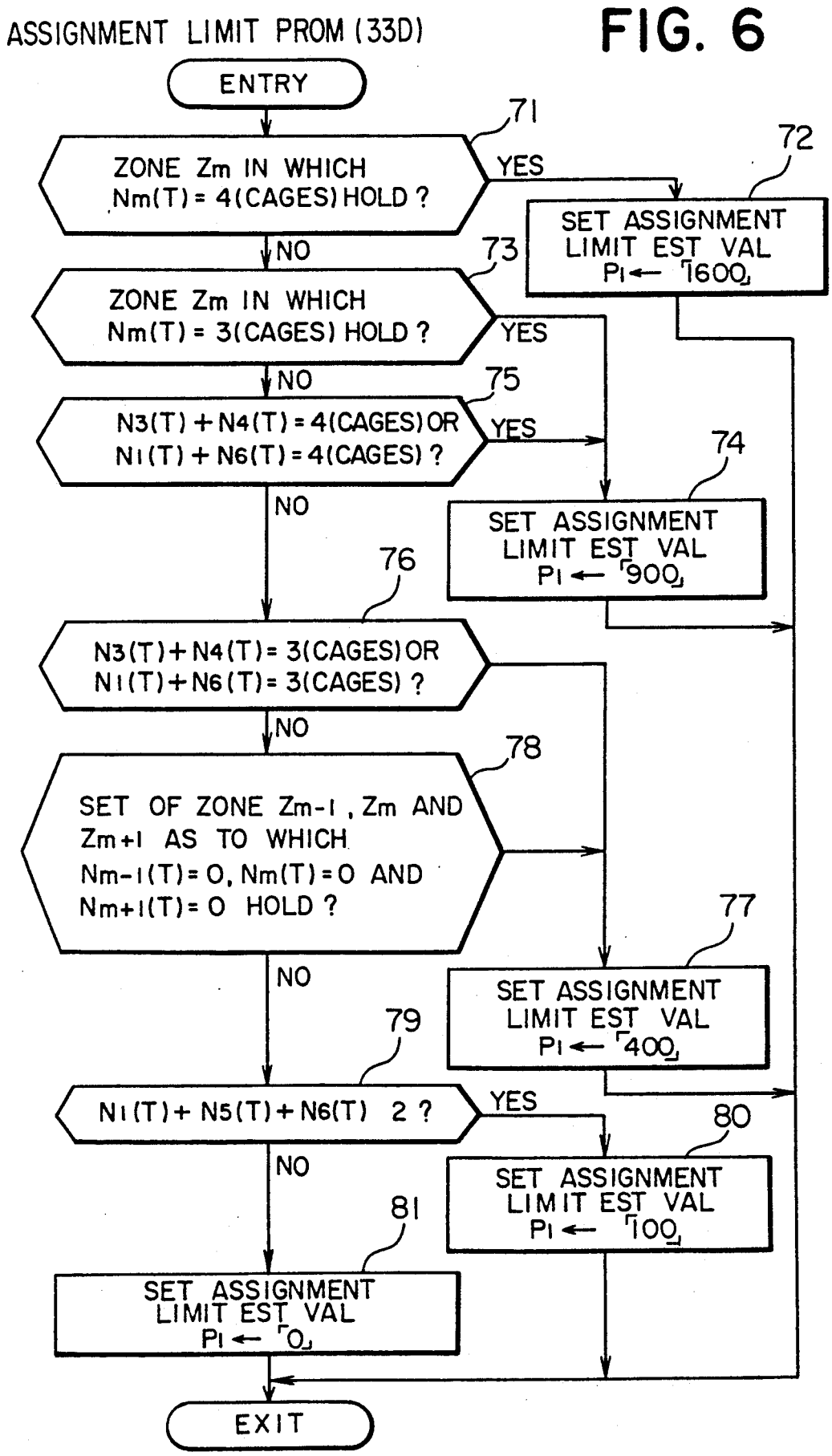
ASSIGNMENT LIMIT PROM (33D)
FIG. 6
ENTRY
71
ZONE Zm IN WHICH Nm(T) = 4(CAGES) HOLD ?
YES
72
SET ASSIGNMENT LIMIT EST VAL Pi ← 「1600」
NO
73
ZONE Zm IN WHICH Nm(T) = 3(CAGES) HOLD ?
YES
NO
75
N3(T) + N4(T) = 4(CAGES) OR N1(T) + N6(T) = 4(CAGES) ?
YES
74
SET ASSIGNMENT LIMIT EST VAL Pi ← 「900」
NO
76
N3(T) + N4(T) = 3(CAGES) OR N1(T) + N6(T) = 3(CAGES) ?
NO
78
SET OF ZONE Zm-1, Zm AND Zm+1 AS TO WHICH Nm-1(T) = 0, Nm(T) = 0 AND Nm+1(T) = 0 HOLD ?
77
SET ASSIGNMENT LIMIT EST VAL Pi ← 「400」
NO
79
N1(T) + N5(T) + N6(T) 2 ?
YES
80
SET ASSIGNMENT LIMIT EST VAL Pi ← 「100」
NO
81
SET ASSIGNMENT LIMIT EST VAL Pi ← 「0」
EXIT

GROUP-SUPERVISORY APPARATUS FOR ELEVATOR SYSTEM

BACKGROUND OF THE INVENTION

This invention relates to a group-supervisory apparatus for an elevator system wherein, among a plurality of cages in the elevator system, a service cage is selected for a hall call and assigned thereto, or it is caused to respond to a call or to stand by therefor.

In a case where a plurality of cages are juxtaposed, a group-supervisory operation is usually performed. One method of the group-supervisory operation is an assignment method, in which as soon as a hall call is registered, assignment estimation values are calculated for respective cages. The cage of the best estimation value is selected and assigned to serve the hall call. Only the assigned cage is caused to respond to the hall call to enhance operating efficiency and to shorten a hall wait time. In the group-supervisory elevator system of such an assignment method, arrival preannouncement lamps for the respective cages and in respective directions are usually disposed in the halls of individual floors to present the preannouncing displays of the assigned cages to users who are waiting in the halls. Therefore, the waiting users can wait for the cages in front of the preannouncement lamps without anxiety.

The assignment estimation values in the method of assigning the cage to the hall call as stated above, are calculated from the viewpoint of finding the optimal cage for allotting the hall call, assuming the present situation to proceed as it is. More specifically, the predictive values of the periods of time (hereinbelow, termed the "arrival expectation times") required for the cages to successively respond to calls and arrive at the halls of the floors are obtained on the basis of the positions and directions of the cages at the present time and the hall calls and cage calls presently registered. The periods of time (hereinbelow, termed the "continuation times") which lapsed since the registrations of the hall calls are obtained. The arrival expectation times and the continuation times are added to calculate the predicted wait times of all the hall calls presently registered. Then, the summation of the predictive wait times or the summation of the square values of the predictive wait times is set as each assignment estimation value. The hall call is allotted to the cage which exhibits the smallest assignment estimation value. With such a prior-art method, in allotting the hall call, whether the cage is optimal is determined on the basis of an extension line of the present situation, and hence, there has occurred the drawback that a hall call registered anew after the allotment becomes a long wait.

An example of the occurrence of the drawback will be explained with reference to FIGS. 12–15. In FIG. 12, letters A and B indicate cages No. 1 and No. 2, respectively, both of which are standing by in closed door states. It is assumed that, in such a situation, down calls 7*d* and 6*d* have been successively registered at the 7th floor and the 6th floor as shown in FIG. 13. According to the assignment estimation values of the prior-art assignment method, the down call 7*d* of the 7th floor is allotted to the cage A and the down call 6*d* of the 6th floor to the cage B to minimize the total wait time. Both the cages travel upwards, and change their directions at the 7th and 6th floors at nearly the same time.

If a down call at a floor above the 7th floor, for example, a down call 8*d* at the 8th floor is registered after the change in the directions, the down call 8*d* of the 8th floor becomes a rear call for either of the cages A and B. Regardless of the cage that the down call 8*d* is allotted to, a long time is taken before this call is serviced resulting in a long waiting time.

In contrast, assuming that the down call 7*d* of the 7th floor is allotted to the cage A, the down call 6*d* of the 6th floor is thereafter registered, and the call 6*d* is also allotted to the cage A, the situation becomes as illustrated in FIG. 14. Thus, even when the down call 8*d* of the 8th floor is registered nearly simultaneously, it does not require a long waiting time, since the cage B was standing by at the 1st floor and renders a direct travel service. In this manner, for the purpose of preventing the long wait, the hall calls need to be allotted so that the cages should not gather to one place, taking into consideration how the cages are arranged in the near future and even making allotments which lengthen the waiting time temporarily.

A so-called zone assignment method wherein a building is divided into a plurality of floor zones and wherein cages are assigned to the zones to serve hall calls is applied to the example stated above. Response to the hall calls is as shown in FIG. 15, and the down call 8*d* of the 8th floor is prevented from becoming the long wait. However, floors included in the individual zones are fixed, so that when a down call at the 5th floor, not the down call 6*d* of the 6th floor, has been registered by way of example, the down calls of the 7th and 5th floors are separately allotted to the respective cages A and B and the 8th-floor down call 8*d* becomes the long wait as shown in FIG. 14. Since, in this manner, the zone assignment method cannot flexibly cope with the registered situation of the hall calls, it still involves the problem that long waiting time arises.

An invention intended to solve this problem and disclosed in the official gazette of Japanese Patent application Publication No. 32625/1980 consists in an assignment method wherein, in order to prevent cages from gathering to one place and to enhance an operating efficiency likewise to the zone assignment method, when a hall call is registered, the cage scheduled to stop at a floor near the floor of the call is assigned thereto. Even in this assignment method, note is taken of the presence or absence of the cage scheduled to stop at the near floor. No judgement is made by properly grasping the changes of a cage arrangement with the lapse of time, including the period of time which is required before the cage scheduled to stop arrives at the floor, how other hall calls are distributed and registered and when they will be responded to, what floors the other cages are on and which directions they are to be operated in, and so forth. Therefore, the problem of the occurrence of a long waiting time still remains.

Another method is disclosed in an invention disclosed in the official gazette of Japanese Patent application Publication No. 56076/1987 consists in an assignment method is shown wherein cages are caused to stand by at getting-off positions, so that when a hall call is registered anew, it is tentatively allotted to the respective cages in succession to expect the getting-off positions of the tentatively assigned cages, the degrees of dispersion of the cages are calculated from the expected getting-off positions of the tentatively assigned cages and the positions of the other cages. The degrees of dispersion are set as the estimation values of the respective cages so that the cage may be assigned more easily as the degree of dispersion is higher, whereby the cage to be assigned is determined from the estimation values of the cages. Thus, the cages fall into a dispersively arranged state even after a service to the hall call has ended, thereby to bring forth the great effect of saving energy owing to the prevention of the wasteful operations of unoccupied cages attributed to the dispersive standby, and also the effect that suspicions of building dwellers can be eliminated.

As obvious from its purpose, however, this assignment method is directed to the period of light traffic such as nighttime and is premised on a case where one hall call has been registered in the state in which all the cages are unoccupied and standing by. Therefore, this assignment method is not applicable to the allotment of hall calls under such a traffic condition that the hall calls are successively registered and that the cages are respectively traveling in response to the calls, and it has had the problem that long waiting times develop. Such a problem is caused by the fact that, since the method is intended to balance the arrangement of the unoccupied cages, the changes of cage positions with the lapse of time are not considered for the cages other than the tentatively assigned cage (in view of the premise of the method, the cage position changes of the other cages need not be considered), and the fact that the hall call allotment is determined with note taken of only the cage arrangement at the point in time at which a previous rider gets off the tentatively assigned cage (at that point of time, all the cages become unoccupied and fall into the standby states).

SUMMARY OF THE INVENTION

This invention has been made in order to solve the problems stated above, and has for its object to provide a group-supervisory apparatus for an elevator system in which the change of a cage arrangement with the lapse of time can be properly grasped and in which the wait times of hall calls can be shortened in the near future since the current time.

The group-supervisory apparatus for an elevator system according to this invention comprises an apparatus having hall call registration means for registering hall calls when hall buttons are depressed, assignment means for selecting a cage to serve from among a plurality of cages and assigning it to the hall call, cage control means for performing operation controls such as determining a traveling direction of the cage, starting and stopping the cage, and opening and closing a door of the cage, thereby causing the cage to respond to a cage call and the allotted hall call, standby means for causing the cage when it has responded to all the calls, to stand by at a floor at which it has responded to the last call or to travel to and stand by at a predetermined floor; cage position prediction means for predictively calculates cage positions and cage directions after the respective cages have successively responded to the cage calls and the allotted hall calls since the current time and a predetermined time has lapsed, and cage number prediction means for predictively calculating the presence or absence or the number of the cages which will lie at predetermined floors or in predetermined floor zones after the lapse of the predetermined time, on the basis of the predicted cage positions and the predicted cage directions, wherein at least one of said assignment means, said cage control means and said standby means is operated using the predicted number of the cages.

In the group-supervisory apparatus for an elevator system according to this invention, at least one of the assignment operation, the cage control operation and the standby operation as predetermined is performed using the predicted value of the number of the cages which will lie at the predetermined floors or in the predetermined floor zones after the lapse of the predetermined time.

BRIEF DESCRIPTION OF THE DRAWINGS

FIGS. 1–10 are diagrams showing an embodiment of a group-supervisory apparatus for an elevator system according to this invention, in which:

FIG. 1 is a general arrangement diagram;

FIG. 2 is a block circuit diagram of a group supervision device;

FIG. 3 is a flow chart of a group supervision program;

FIG. 4 is a flow chart of a cage position prediction program;

FIG. 5 is a flow chart of a cage number prediction program;

FIG. 6 is a flow chart of an assignment limitation program;

FIG. 7 is a diagram showing the zoning of a building; and

FIGS. 8 thru 10 are diagrams showing the relationships between calls and cage positions.

Throughout the drawings, the same symbols indicate identical or equivalent portions.

DETAILED DESCRIPTION OF THE PREFERRED EMBODIMENTS

FIGS. 1–10 are diagrams showing an embodiment of this invention. In this embodiment, it is assumed that four cages are installed in a 12-storey building.

Figure 1:
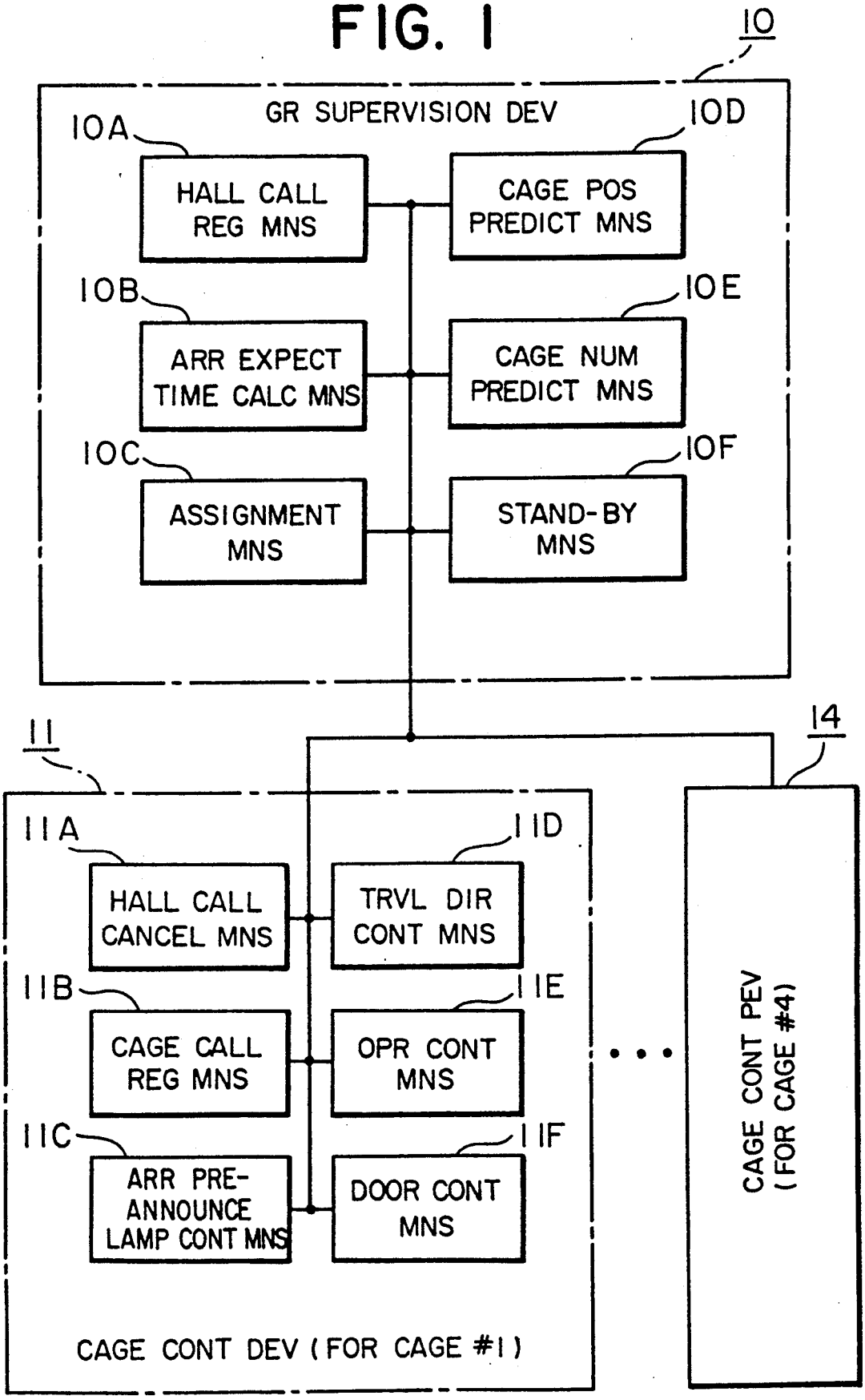

FIG. 1 is a diagram of the general arrangement of the embodiment, which is constructed of a group supervision device 10 and cage control devices 11–14 for the cages No. 1–No. 4 to be controlled by the device 10. The group supervision device 10 includes hall call registration means 10A for registering and canceling the hall calls (up calls and down calls) of respective floors and for calculating periods of time having lapsed since the registrations of the hall calls, namely, continuation times; arrival expectation time calculation means 10B for calculating the predictive values of periods of time required for the respective cages to arrive at the halls of the respective floors (in individual directions), namely, arrival expectation times; and assignment means 10C for selecting the best cage to serve the hall call and assigning it to this hall call. The assignment means executes an assignment calculation on the basis of the predicted wait time of the hall call and a predicted cage number to be described below. The group supervision device 10 also includes cage position prediction means 10D for predictively calculating the cage positions and cage directions of the cages after the lapse of a predetermined period of time T since the current point of time; cage number predictions means 10E for predictively calculating the number of the cages which will lie in a predetermined floor zone after the lapse of the predetermined time T, on the basis of the predicted cage positions and the predicted cage directions; and standby means 10F for causing the cage, when it has responded to all the calls, to stand by at the floor of the last response or at a specified floor.

The cage control device 11 for the cage No. 1 is provided with well-known hall call cancellation means 11A for outputting hall call cancellation signals corresponding to the hall calls of the respective floors, well-known cage call registration means 11B for registering the cage calls of the respective floors, well-known arrival preannouncement lamp control means 11C for controlling the lighting of the arrival preannouncement lamps (not shown) of the respective floors, well-known traveling direction control means 11D for determining the traveling direction of the cage, well-known operation control means 11E for controlling the travel and stop of the cage in order to respond to the cage call and the allotted hall call, and well-known door control means 11F for controlling the opening and closure of the door of the cage. Each of the cage control devices 12–14 for the cages Nos. 2–4 is constructed similarly to the cage control device 11 for the cage No. 1.

Figure 2:
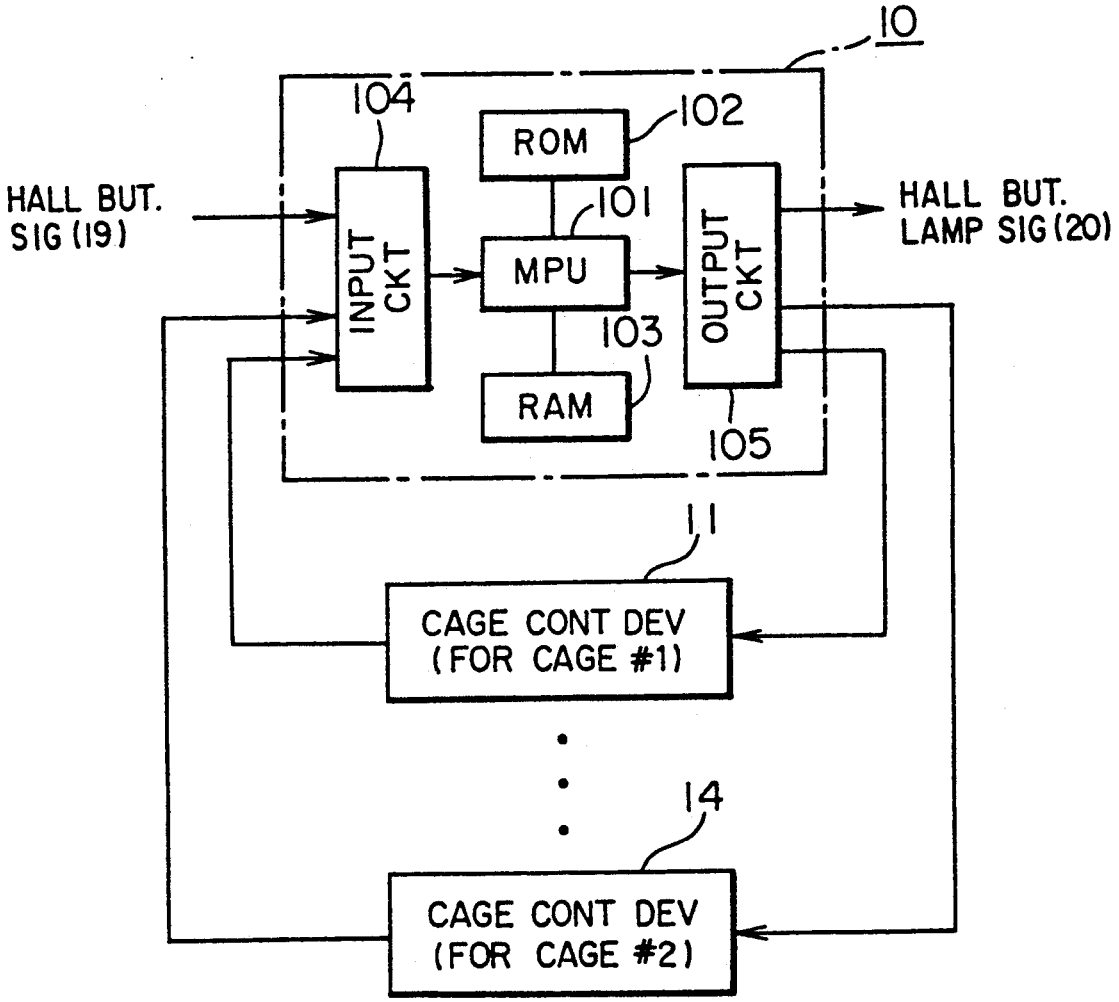

FIG. 2 is a block circuit diagram of the group supervision device 10. The group supervision device 10 is constructed of a microcomputer (hereinbelow, abbreviated to "MC"), which includes an MPU (microprocessing unit) 101, a ROM 102, a RAM 103, an input circuit 104 and an output circuit 105. The input circuit 104 is supplied with a hall button signal 19 from the hall button of each floor and the status signals of the cages Nos. 1–4 from the cage control devices 11–14, while the output circuit 105 delivers a signal 20 to a hall button lamp built in each hall button and command signals to the cage control devices 11–14.

Figure 3:
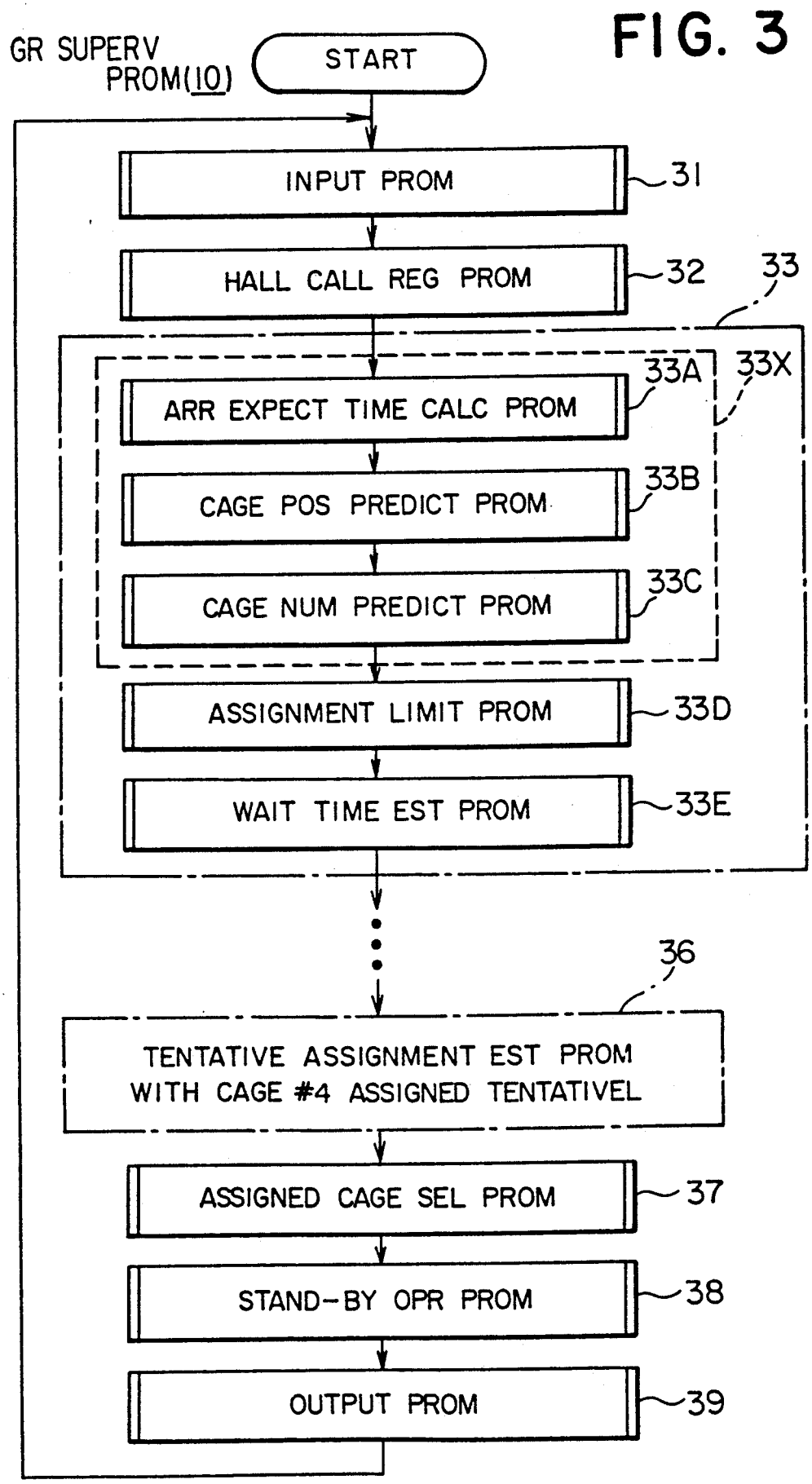
Figure 5:
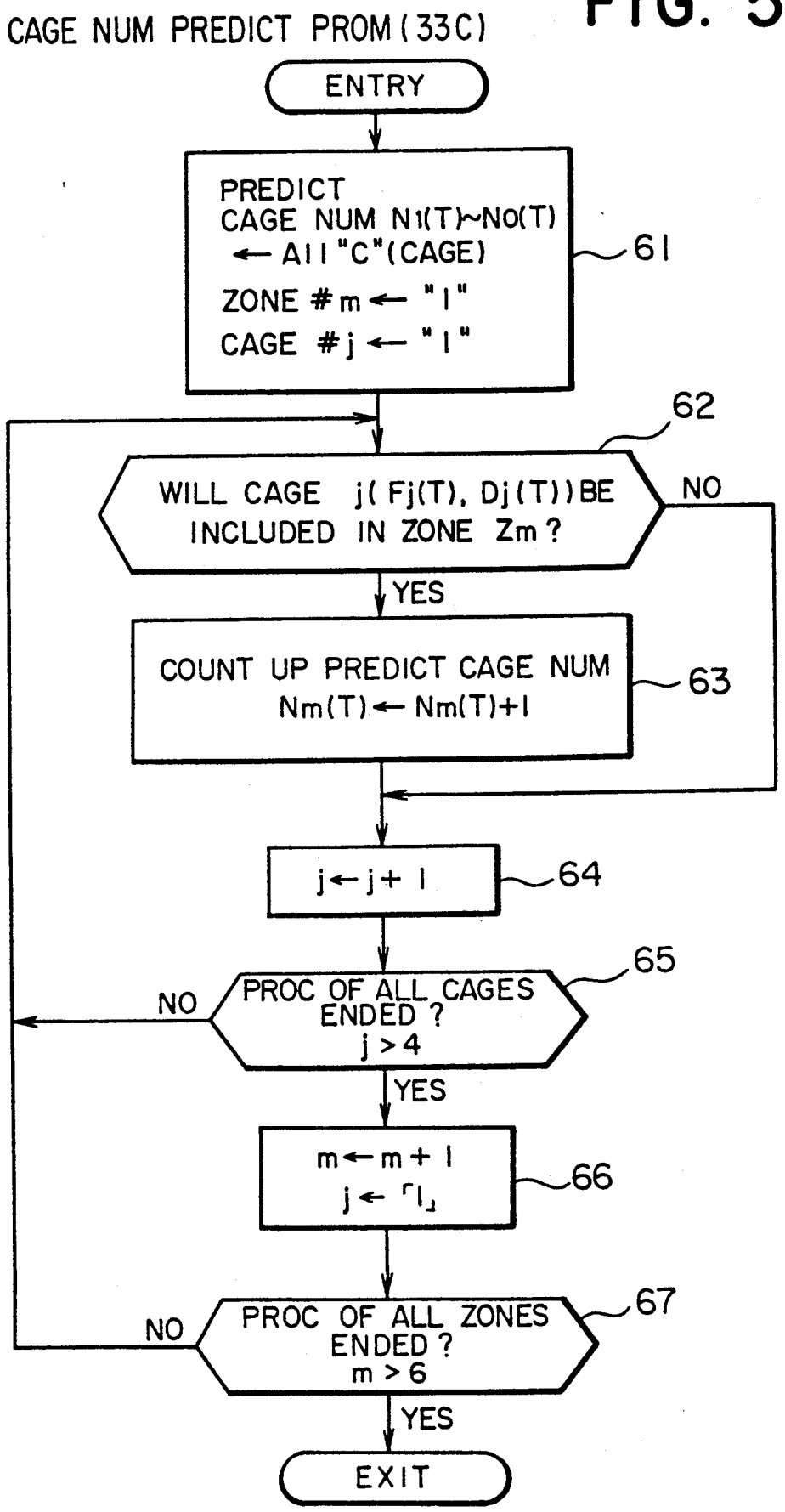
Figure 7:
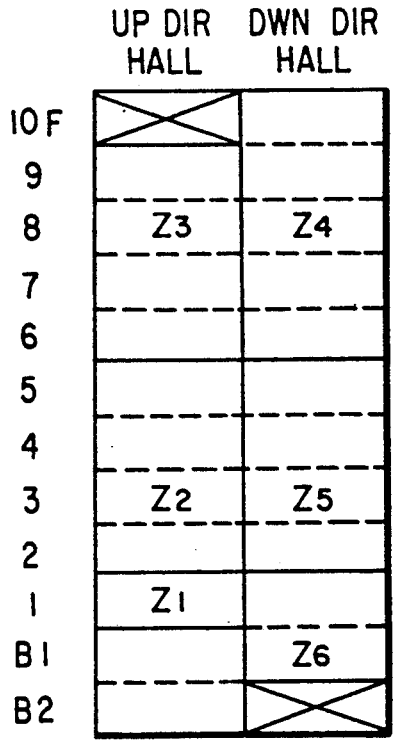

Next, the operation of this embodiment will be described with reference to FIGS. 3–7. FIG. 3 is a flow chart showing a group supervision program which is stored in the ROM 102 of the MC constructing the group supervision device 10, FIG. 4 is a flow chart showing a cage position prediction program similarly stored, FIG. 5 is a flow chart showing a cage number prediction program similarly stored, FIG. 6 is a flow chart showing an assignment limitation calculation program similarly stored, and FIG. 7 is a diagram showing the state in which the building is divided into a plurality of floor zones.

First, the group supervision operation will be outlined in conjunction with FIG. 3.

An input program at step 31 functions to receive the hall button signals 19 and the status signals from the cage control devices 11–14 (such as cage position, direction, stop, travel, open or closed door state, cage load, cage call and hall call cancellation signals), and it is well known.

A hall call registration program at step 32 functions to decide the registration or cancellation of each hall call and the turn-on or -off of each hall button lamp and to calculate the continuation time of each hall call, and it is well known.

In tentative assignment estimation programs at steps 33–36, when a hall call C is registered anew, the respective cages No. 1–No. 4 are tentatively assigned to this hall call C, and assignment limitation estimation values $P_1$–$P_4$ and wait time estimation values $W_1$–$W_4$ on those occasions are respectively calculated.

In an arrival expectation calculation program 33A within the tentative assignment estimation program 33 of the cage No. 1, arrival expectation times $A_j(i)$ for the respective floors i (where i=1, 2, 3, . . . and 11 denote the up direction halls of the floors B2, B1, 1, . . . and 9, respectively, and i=12, 13, . . . , 21 and 22 denote the down direction halls of the floors 10, 9, . . . , 1 and B1, respectively) in the case of tentatively allotting the new registered hall call C to the cage No. 1 are calculated as to the corresponding cage j (j=1, 2, 3 or 4). The arrival expectation times are calculated assuming by way of example that the cage requires 2 seconds for advancing the distance of one floor and 10 seconds for one stop and that the cage travels round to all the halls in succession. Incidentally, the calculation itself of the arrival expectation time is well known.

In a cage position prediction program at step 33B, the predicted cage positions $F_1(T)$–$F_4(T)$ and predicted cage directions $D_1(T)$–$D_4(T)$ of the respective cages No. 1–No. 4 after the lapse of the predetermined time T, in the case of tentatively allotting the new hall call C to the cage No. 1 are predictively calculated as to all the cages. This will be described in detail with reference to FIG. 4.

In the cage position prediction program 33B in FIG. 4, the new hall call C is tentatively allotted to the cage No. 1 at step 41. Step 51 which consists of steps 42–50 indicates a flow for calculating the predicted cage position $F_1(T)$ and predicted cage direction D1(T) of the cage No. 1 after the predetermined time T. When there is a hall call to which the cage No. 1 is assigned, the flow proceeds from step 42 to step 44. Here, the terminal floor ahead of the floor of the remotest allotted hall call is predicted as the final call floor of the cage No. 1, and a final call prediction hall $h_1$ is set considering also the arrival direction (down direction at the top floor and up direction at the bottom floor) of the cage at the final call floor. In addition, when only a cage call exists without the hall call allotted to the cage No. 1, the flow proceeds along the steps 42→43→45. Here, the remotest cage call floor is predicted as the final call floor of the cage No. 1, and a final call prediction hall $h_1$ is set considering also the arrival direction of the cage on that occasion. Further, when the cage No. 1 has neither the allotted hall call nor the cage call, the flow proceeds along the steps 42→43→46. Here, the cage position floor of the cage No. 1 is predicted as the final call floor thereof, and a final call prediction hall $h_1$ is set considering also the direction of the cage on that occasion.

When the final call prediction hall $h_1$ is found in this way, the predictive value of a period of time $t_1$ required for the cage No. 1 to become an unoccupied cage (hereinbelow, termed "unoccupied cage prediction time") is subsequently obtained at the step 47. The unoccupied cage prediction time $t_1$ is evaluated by adding up the arrival expectation time $A_1(h_1)$ for the final call prediction hall $h_1$ and the predictive value $T_s$(=10 seconds) of the stop time at that hall. By the way, in the case where the cage position floor has been set as the final call prediction hall $h_1$, the remaining period of time of the stop time is predicted according to the states of the cage (the states in which the cage is traveling or decelerating, the door is being opened, is open or is being closed, etc.), and it is set as the unoccupied cage prediction time $t_1$.

Subsequently, the predicted cage position $F_1(T)$ and predicted cage direction $D_1(T)$ of the cage No. 1 after the predetermined time T are calculated at the steps 48–50. When the unoccupied cage prediction time $t_1$ of the cage No. 1 is not greater than the predetermined time T, it means that the cage No. 1 becomes unoccupied before or upon the lapse of the predetermined time T, and hence, the flow proceeds along the steps 48→49. Here, on the basis of the final call prediction hall $h_1$, the floor of the hall $h_1$ is set as the predicted cage position $F_1(T)$ after the lapse of the predetermined time T. In addition, the predicted cage direction $D_1(T)$ is set at "0." Incidentally, the predicted cage direction $D_1(T)$ expresses no direction with "0," the up direction with "1" and the down direction with "2."

In contrast, when the unoccupied cage prediction time $t_1$ of the cage No. 1 is greater than the predetermined time T, it implies that the cage No. 1 will not become unoccupied even when the predetermined time T has lapsed, and hence, the flow proceeds along the steps 48→50. Here, the floor of the hall i at which the arrival expectation time $A_1(i-1)$ of the hall $(i-1)$ and that $A_1(i)$ of the hall i satisfy $\{A_1(i-1)+T_s \leqq T < A_1(i)+T_s\}$ is set as the predicted cage position $F_1(T)$ after the lapse of the predetermined time T, and the same direction as that of the hall i is set as the predicted cage direction $D_1(T)$.

In this way, the predicted cage position $F_1(T)$ and the predicted cage direction $D_1(T)$ for the cage No. 1 are calculated at the step 51. Also the predicted cage positions $F_2(T)$–$F_4(T)$ and the predicted cage directions $D_2(T)$–$D_4(T)$ for the cages No. 2–No. 4 are respectively calculated by steps 52–54 each of which is formed of the same procedure as that of the step 51.

Referring to FIG. 3 again, a cage number prediction program at a step 33C calculates the numbers of the cages which will lie at the predetermined floors or in the predetermined floor zones after the lapse of the predetermined time T, for example, predicted cage numbers $N_1(T)$–$N_6(T)$ for the respective floor zones $Z_1$–$Z_6$ each of which is configured of one floor or a plurality of continuous floors as shown in FIG. 7, in the case of tentatively allotting the new hall call C to the cage No. 1. This will be described in detail with reference to FIG. 5.

In the cage number prediction program 33C in FIG. 5, step 61 initializes the predicted cage numbers $N_1(T)$–$N_6(T)$ to "0" respectively and the cage No. j and zone No. m to "1" respectively. At step 62, whether the cage No. j lies in the zone $Z_m$ after the lapse of the predetermined time T is decided on the basis of the predicted cage position $F_j(T)$ and predicted cage direction $D_j(T)$ of the cage No. j. When the cage No. j is predicted to lie in the zone $Z_m$, the predicted cage number $N_m(T)$ of the zone $Z_m$ is increased by one at step 63. At step 64, the cage No. j is increased by one, and at step 65, if all the cages have been decided is checked. When the processing of all the cages has not ended, the flow returns to step 62, and the processing stated above is repeated.

When the processing of steps 62 and 63 has ended for all the cages as to the zone $Z_m$ having the zone No. m, step 66 subsequently increases the zone No. m by one and initializes the cage No. j to "1." Thereafter, the processing of steps 62–65 is similarly repeated until the cage No. $j>4$ holds. When the above processing has ended as to all the zones $Z_1$–$Z_6$, the zone No. $m>6$ holds at a step 67, and the processing of this cage number prediction program 33C is ended. By the way, the steps 33A–33C constitute tentative assignment means 33X.

In an assignment limitation program at step 33D within the group supervision program 10 in FIG. 3, an assignment limitation estimation value $P_1$ which is intended to make difficult the assignment of the cage No. 1 to the new hall call C is calculated on the basis of the predicted cage numbers $N_1(T)$ –$N_6(T)$. The assignment limitation estimation value $P_1$ is set at a greater value as the cages are more prone to gather to one place. This will be described in detail with reference to FIG. 6.

In the assignment limitation program 33D in FIG. 6, step 71 decides if there is a zone $Z_m$ in which the predicted cage number $N_m(T)=4$ holds, that is, if all the cages concentrate in that one zone. In the presence of the above zone, the assignment limitation estimation value $P_1$ is set to the maximum value "1600" at a step 72. Step 73 decides if there is a zone $Z_m$ in which the predicted cage number $N_m(T)=3$ holds, that is, if most of the cages concentrate in one zone. In the presence of the above zone, the assignment limitation estimation value $P_1$ is set to "900" at step 74.

Step 75 decides if all the cages concentrate at the upper floors (in the zones $Z_3$ and $Z_4$) or at the lower floors (in the zones $Z_1$ and $Z_6$) $(N_3(T)+N_4(T)=4$ or $N_1(T)+N_6(T)=4)$. When they concentrate, the assignment limitation estimation value $P_1$ is similarly set to "900" at the step 74. Step 76 decides if most of the cages similarly concentrate at the upper floors or the lower floors $(N_3(T)+N_4(T)=3$ or $N_1(T)+N_6(T)=3)$. When most of the cages concentrate, the assignment limitation estimation value $P_1$ is set to "400" at a step 77.

Step 78 decides if there is a combination in which all of the predicted cage numbers $N_{m-1}(T)$, $N_m(T)$ and $N_{m+1}(T)$ of the three adjacent zones $Z_{m-1}$, $Z_m$ and $Z_{m-1}$ become "0." In the presence of the set of such zones $Z_{m-1}$, $Z_m$ and $Z_{m+1}$, the assignment limitation estimation value $P_1$ is similarly set to "400" at the step 77.

Lastly, step 79 decides if there is only one cage at the main floor (1st floor) and its neighboring floors (in the zones $Z_1$, $Z_5$ and $Z_6$) of many users $(N_1(T)+N_5(T)+N_6(T)<2)$. In the absence of at least two cages at and near the main floor, the assignment limitation estimation value $P_1$ is set to "100" at a step 80, whereas in the presence of at least two cages, the assignment limitation estimation value $P_1$ is set to "0" at a step 81.

In this way, the assignment limitation estimation values $P_1$ in the case of tentatively allotting the hall call C to the cage No. 1 are set on the basis of the predicted cage numbers $N_1(T)$–$N_6(T)$ in the respective zones $Z_1$–$Z_6$.

A wait time estimation program in step 33E within the group supervision program 10 in FIG. 3 calculates an estimation value $W_1$ concerning the wait times of the respective hall calls in the case of tentatively allotting the new hall call C to the cage No. 1. Since the calculation of the wait time estimation value $W_1$ is well known, it shall not be described in detail. By way of example, the predicted wait times U(i) of the respective hall calls i (where i=1, 2, . . . and 22, and "0" second is set when no hall call is registered) are evaluated, and the wait time estimation value is obtained as the summation of the square values of the predicted wait times, namely, as $W_1=U(1)^2+U(2)^2+\ldots+U(22)^2$.

In this way, the assignment limitation estimation value $P_1$ and the wait time estimation value $W_1$ in the case of tentatively assigning the cage No. 1 to the new hall call C are calculated by the tentative assignment estimation program 33 of the cage No. 1. The assignment limitation estimation values $P_2$–$P_4$ and wait time estimation values $W_2$–$W_4$ of the cages of the other Nos. are similarly calculated by the tentative assignment estimation programs 34–36, respectively.

Subsequently, an assigned cage selection program at step 37 selects one assigned cage on the basis of the assignment limitation estimation values $P_1$–$P_4$ and the wait time estimation values $W_1$–$W_4$. In this embodiment, overall estimation values $E_j$ in the case of tentatively assigning the cages Nos. j to the new hall call C are found according to $E_j = W_j + k \cdot P_j$ (k: constant), and the cage whose overall estimation value $E_j$ is the smallest is selected as the regular assigned cage. An assignment command and a preannouncement command which correspond to the hall call C are set for the assigned cage.

Further, in a standby operation program at step 38, when an unoccupied cage having responded to all the hall calls arises, it is decided whether the unoccupied cage shall stand by at the floor of the last call as it is or stand by at a specified floor in order to prevent the cages from gathering at one place. When the standby at the specified floor has been decided, a standby command for causing the unoccupied cage to travel to the specified floor is set for this unoccupied cage.

By way of example, the predicted cage numbers of the zones $Z_1$–$Z_6$ after the lapse of the predetermined time T, in the case of tentatively causing the unoccupied cage to stand by in the respective zones, are calculated in the same way as in the foregoing, and a tentative standby zone according to which the cages do not gather at the upper floors or the lower floors is selected on the basis of the predicted cage numbers. Then, when the floor of the last call is included in the selected tentative standby zone, the unoccupied cage is caused to stand by at the floor of the last call as it is, and when the floor of the last call is not included in the tentative standby zone, the unoccupied cage is caused to travel to the specified floor within the tentative standby zone and to stand by there.

Lastly, in an output program at a step 39, the hall button lamp signals 20 set as described above are transferred to the halls, and the assignment signals, preannouncement signals, standby commands, etc. are transferred to the cage control devices 11–14.

In such procedures, the group supervision program at the steps 31–39 is repeatedly executed.

Next, the operation of the group supervision program 10 in this embodiment will be described more concretely with reference to FIGS. 8–10. For the sake of brevity, there will be described a case where two cages A and B are installed in the building illustrated in FIG. 7.

Figure 8:
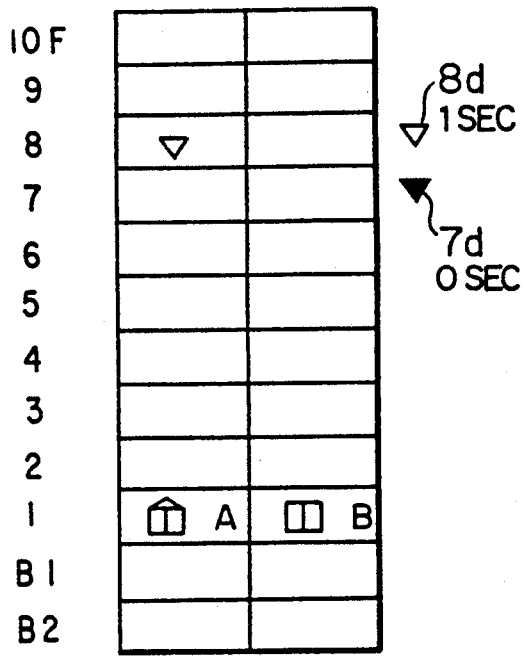

In FIG. 8, it is assumed that a down call **8*d* at the 8th floor is allotted to the cage A and that a down call 7*d*** *l at the* 7th floor is registered immediately after the allotment (i.e. after 1 second). On this occasion, the predicted wait times of the down call **8*d* of the 8th floor and the down call 7*d* of the 7th floor in the case of tentatively assigning these calls to the cage A become 15 seconds and 26 seconds, respectively, and the wait time estimation value $W_A$ at this time becomes $W_A = 15^2 + 26^2 32\ 901$. On the other hand, the predicted wait times of the down call 8*d* of the 8th floor and the down call 7*d* of the 7th floor in the case of tentatively assigning these calls to the cage B become 15 seconds and 12 seconds, respectively, and the wait time estimation value $W_B$ at this time becomes $W_B = 15^2 + 12^2 = 369$. With the prior-art assignment method, accordingly, the down call 7*d*** of the 7th floor is allotted to the cage B because of $W_B < W_A$.

Figure 9:
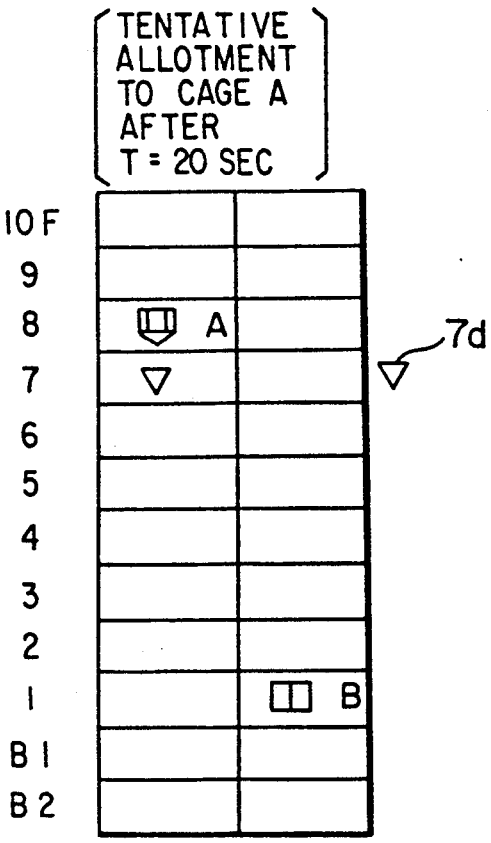
Figure 10:
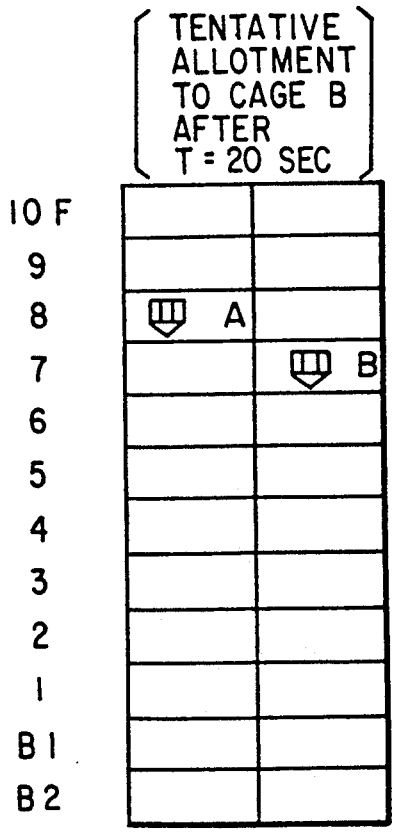

Now, the cage positions after the lapse of the predetermined time T, in the cases of tentatively allotting the down call **7*d* of the 7th floor to the cages A and B, become as shown in FIGS. 9 and 10, respectively. Thus, the predicted cage numbers in the case of the tentative allotment to the cage become $N_1(T)=1$, $N_4(T)=1$ and $N_2(T)=N_3(T)=N_5(T)=N_6(T)=0$, and the cage numbers in the case of the tentative allotment to the cage B become $N_4(T)=2$ and $N_1(T)=N_2(T)=N_3(T)=N_5(T)=N_6(T)=0$. Although, in this example, the cage of no direction is regarded as being in the up direction, the direction may be properly determined depending upon the cage position. In the case of the tentative allotment to the cage A, it cannot be said that the cages gather, and hence, the assignment limitation estimation value becomes $P_A=0$. In contrast, $N_4(T)=2$ corresponds to a case where all the cages lie in one zone, and hence, the assignment limitation estimation value becomes $P_B=1600$ in the same way of consideration as the step 71 of the assignment limitation program 33D in FIG. 6. Consequently, the overall estimation values become $E_A = W_A + P_A = 901 + 0 = 901$ and $E_B = W_B + P_B = 369 + 1600 = 1969$, and $E_1 < E_B$ holds. After all, therefore, the down call 7*d*** of the 7th floor is allotted to the cage A.

With the prior-art assignment method, the down call **7*d* is allotted to the cage B, and in the near future, the cages will travel in clustered fashion as illustrated in FIG. 10 and will become liable to incur long wait calls (i.e. long waiting times in the halls). In contrast, according to this invention, the down call 7*d*** is allotted to the cage A in consideration of the cage arrangement after the lapse of the predetermined time T, whereby such clustered traveling can be prevented.

As thus far described, according to the embodiment, the cage positions and cage directions after the cages have successively responded to the calls since the current time and the predetermined time has lapsed, are predictively calculated, and the cage numbers in the respective zones after the lapse of the predetermined time are predictively calculated on the basis of the predicted cage positions and cage directions, so as to perform the assignment operations and standby operations in accordance with the predicted cage numbers, so that the cages are prevented from concentrating in one place, and the wait times of the hall calls can be shortened in the near future with respect to the present time.

In the embodiment, in predicting the cage position and cage direction after the lapse of the predetermined time T, the floor at which the cage will end its response to the last call and will become unoccupied and the period of time which is required till then are first predicted, whereupon the cage position and cage direction after the lapse of the predetermined time T are predicted. This is based on the assumption that, when the cage becomes unoccupied, it stands by at the corresponding floor as it is. In a case where the unoccupied cage is determined to always stand by at a specified floor, the cage position and cage direction may be predicted assuming that the cage is caused to travel to the specified floor. Besides, in a traffic condition in which the possibility that the cage becomes unoccupied is in which low, that is, the traffic volume is comparatively large, it is easy that the cage position and cage direction are predictively calculated by omitting the calculations of the unoccupied cage prediction time and last call prediction hall and under the condition under which the cage does not become unoccupied even after the lapse of the predetermined time T. Further, the cage position and cage direction can be predicted by taking into consideration also a call which will arise anew before or upon the lapse of the predetermined time T. Still further, the method of calculating the last call prediction hall may well be one which predicts the last call prediction hall delicately on the basis of the occurrence probabilities of cage calls and hall calls evaluated statistically, unlike the simplified one in this embodiment.

In addition, although the building is divided into the zones as shown in FIG. 7 in the embodiment, it is easy to sequentially alter the manner of setting zones, depending upon the number of floors as well as the number of installed cages and also time zones and the intended uses of the respective floors (such as the main floor, a dining room floor, a meeting room floor and a transfer floor). Besides, it is not always necessary to determine the zones in consideration of the directions of the halls.

Furthermore, in the embodiment, (1) in the case of tentative assignment where the predicted cage number of a predetermined zone becomes, at least, a prescribed value, (2) in the case of tentative assignment where the predicted cage number of a specified zone (upper floors or lower floors) becomes, at least, a prescribed value, (3) in the case of tentative assignment where the predicted cage number of a specified zone (the main floor) and its neighboring zones becomes less than a prescribed value, or (4) in the case of tentative assignment where the predicted cage number of a predetermined zone becomes 0 and where also the predicted cage number of a zone adjacent thereto becomes 0, the assignment limitation estimation value (>0) for limiting the assignment of the cage to a hall call is set, but the condition of setting the assignment limitation estimation value based on the predicted cage number is not restricted thereto. The setting condition may be any as long as it decides whether or not the cages concentrate, using the predicted cage numbers. Unlike the fixed values such as "1600," "900," "400" and "100" in the embodiment, the assignment limitation estimation values may well be set by expressing the setting condition as a fuzzy set and on the basis of the membership function values thereof.

Moreover, in the embodiment, as the means for limiting the assignment to the hall call, there is used the system in which a specified cage is endowed with the assignment limitation estimation value greater in magnitude than the other cages, this value is weighted and then added to the wait time estimation value so as to obtain the overall estimation value, and the cage whose overall estimation value is the smallest is selected as the regular assigned cage. The fact that, in this manner, the assignment limitation estimation value is combined with the other estimation value to estimate the cage overall and to assign the cage, is nothing but preferentially assigning the cage whose assignment limitation estimation value is small. That is, the cage whose assignment limitation estimation value is greater is more difficult to assign than the other cages.

Besides, the means for limiting the assignment to the hall call is not restricted to that of the embodiment, but it may well be a system in which the cage satisfying the assignment limiting condition is excluded from the cages to-be-assigned beforehand. There is considered, for example, a system in which the cage of large assignment limitation estimation value is excluded from the cages to-be-assigned on the ground that, from among the cages whose assignment limitation estimation values are smaller than a predetermined value, the regular assigned cage is selected according to a predetermined criterion (for example, the smallest wait time estimation value or the shortest arrival time).

Further, in the embodiment, the wait time estimation value is the summation of the square values of the predicted wait times of the hall call, but the method of calculating the wait time estimation value is not restricted thereto. Obviously this invention is applicable even with, for example, a system in which the summation of the predicted wait times of a plurality of hall calls registered is set as the wait time estimation value, or the maximum value of such predicted wait times is set as the wait time estimation value. Of course, the estimation item which is combined with the assignment limitation estimation value is not restricted to the wait time, but the assignment limitation estimation value may well be combined with an estimation index which contains the miss of preannouncement, a full capacity, or the like as the estimation item.

Figure 11:
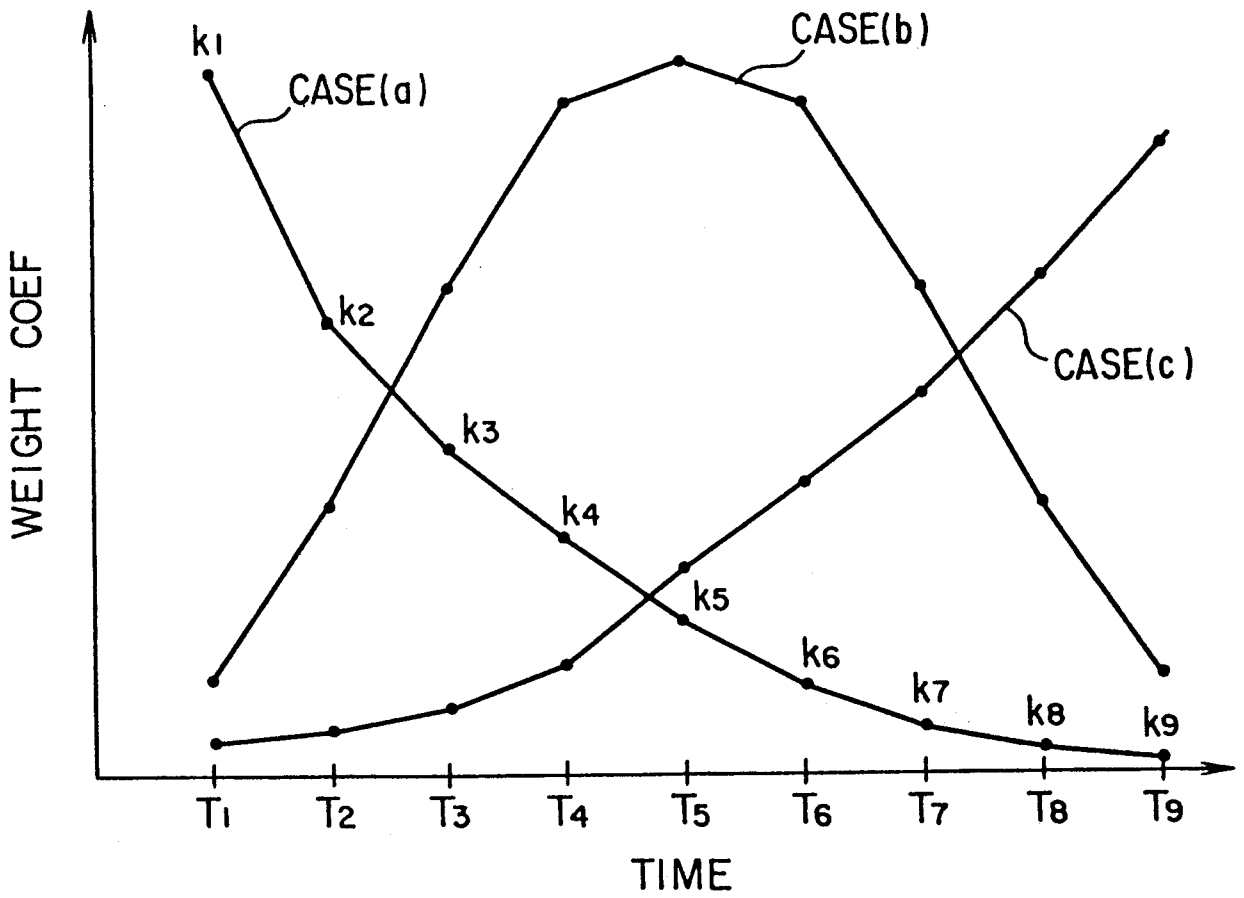
FIG. 11 is a diagram for explaining other embodiments of this invention.
Figure 12:
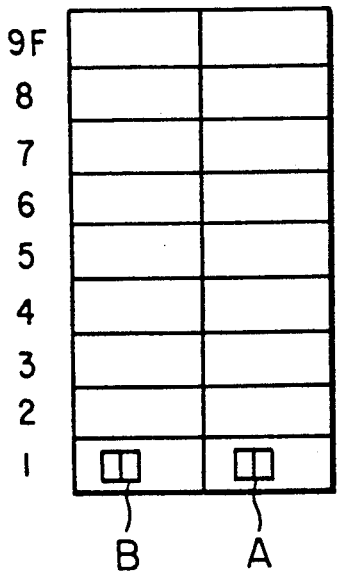
FIG. 12 PRIOR ART
FIGS. 12–15 illustrate prior-art group-supervisory apparatuses for elevator systems, and are diagrams each elucidating the relationship between calls and cage positions.
Figure 13:
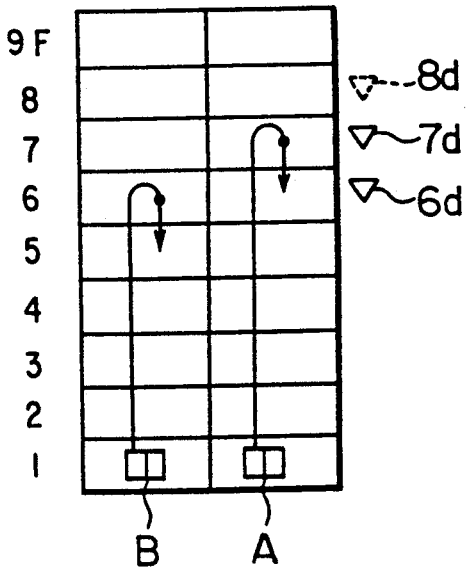
FIG. 13 PRIOR ART
Figure 14:
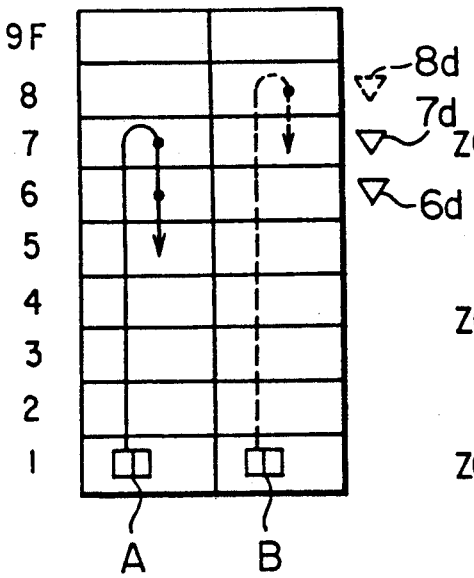
FIG. 14 PRIOR ART
Figure 15:
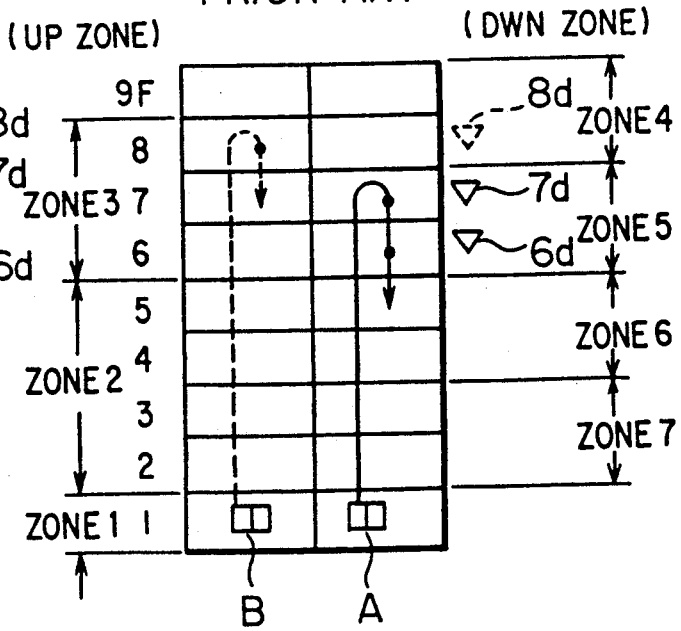
FIG. 15 PRIOR ART

In the embodiment, the cage positions and cage directions of the respective cages after the lapse of the single predetermined time T are predicted, and the assignment limitation estimation values are calculated on the basis of them. However, it is also easy to set the final assignment limitation estimation value P as follows: The cage positions and cage directions after the lapses of a plurality of predetermined times $T_1, T_2, \ldots$ and $T_r$ ($T_1<T_2<\ldots<T_r$) are predicted as to the respective cages, and the predicted cage numbers $N_m(T_1)-N_m(T_r)$ after the lapses of the plurality of predetermined times $T_1, T_2, \ldots$ and $T_r$ are calculated as to the respective zones $Z_m$ ($m=1, 2, \ldots$). Then, assignment limitation estimation values $P(T_1), P(T_2), \ldots$ and $P(T_r)$ respectively set by combinations $\{N_1(T_1), N_2(T_1), \ldots\}$, $\{N_1(T_2), N_2(T_2), \ldots\}, \ldots$ and $\{N_1(T_r), N_2(T_r), \ldots\}$ are weighted and added, that is, the final assignment limitation estimation value P is calculated according to a formula $P=k_1 \cdot P(T_1)+k_2 \cdot P(T_2)+\ldots+k_r P(T_r)$ (where $k_1, k_2, \ldots$ and $k_r$ denote weighting coefficients). In this case, not only the cage arrangement at the certain point of time T is noticed, but also the cage arrangements at the plurality of points of time $T_1, T_2, \ldots$ and $T_r$ are wholly estimated. Therefore, the wait times of the hall calls can be further shortened in the near future with respect to the current time. As regards the weighting coefficients $k_1, k_2, \ldots$ and $k_r$, several setting methods are considered depending upon the cage arrangements of the points of time deemed important, as illustrated in FIG. 11 by way of example, and they may be properly selected according to traffic conditions, the natures of buildings, etc.

Further, in the embodiment, the hall call allotment operation is performed on the basis of the predicted cage numbers of the respective zones after the lapse of the predetermined time. The predicted cage numbers can also be utilized as conditions for controlling the basic operations of the cages so as to permit the cages to dispersively respond to hall calls, in such a case where the traveling direction of the cage is determined at the floor of the last call or where the open period of time of the door is lengthened or shortened.

As described above, the group-supervisory apparatus for an elevator system according to this invention consists in an apparatus having hall call registration means for registering hall calls when hall buttons are depressed, assignment means for selecting a cage to serve from among a plurality of cages and assigning it to the hall call, cage control means for performing operation controls such as determining a traveling direction of the cage, starting and stopping the cage, and opening and closing a door of the cage, thereby causing the cage to respond to a cage call and the allotted hall call, and standby means for causing the cage when it has responded to all the calls, to stand by at a floor at which it has responded to the last call or to travel to and stand by at a predetermined floor; said apparatus being so constructed that cage position prediction means predictively calculates cage positions and cage directions after the respective cages have successively responded to the cage calls and the allotted hall calls since the current time and a predetermined time has lapsed, that cage number prediction means predictively calculates the presence or absence or the number of the cages which will lie at predetermined floors or in predetermined floor zones after the lapse of the predetermined time, on the basis of the predicted cage positions and the predicted cage directions, and that at least one of said assignment means, said cage control means and said standby means is operated using the predicted number of the cages. It is therefore possible to properly grasp the change of the cage arrangement with the lapse of time, and to shorten the wait times of the hall calls in the near future with respect to the current time.

In addition, the apparatus is provided with assignment limitation means for limiting the regular assignment of tentatively assigned cages, depending upon the predictive number of the cages predicted to lie within the predetermined floor zone, under the assumption that the respective cages respond to the hall calls tentatively allotted by tentative assignment means. This brings forth the effect that the concentrative assignment of the cage to any of the floor zones can be avoided.

What is claimed is:

1. A group-supervisory elevator system comprising:

hall call registration means for registering hall calls when hall buttons are depressed;

assignment means for selecting a cage from among a plurality of cages and assigning the selected cage to a hall call;

cage control means for controlling a traveling direction of each cage, starting and stopping each cage, and opening and closing a door of each cage, thereby causing the assigned cage to respond to a cage call and the corresponding hall call;

standby means for causing an assigned cage, after it has responded to all corresponding calls, to stand by at a floor at which the assigned cage responded to the last call;

cage position prediction means for predictively calculating cage positions and cage directions after the respective cages have successively responded to the cage calls and the correspondingly assigned hall calls after the lapse of a predetermined time; and cage number prediction means for predictively calculating the presence and absence and the number of the cages at predetermined floors or in predetermined floor zones after the lapse of the predetermined time, on the basis of the predicted cage positions and the predicted cage directions, wherein at least one of said assignment means, said cage control means and said standby means is actuated using the number of the cages predicted by said cage number prediction means.

2. A group-supervisory elevator system comprising:

hall call registration means for registering hall calls when hall buttons are depressed;

assignment means for selecting a cage from among a plurality of cages and assigning the selected cage to a hall call;

cage control means for controlling a traveling direction of each cage, starting and stopping each cage, and opening and closing a door of each cage, thereby causing the assigned cage to respond to a cage call and the corresponding hall call;

cage position prediction means for predictively calculating cage positions and cage directions after the respective cages have successively responded to the cage calls and the correspondingly assigned hall call after the lapse of a predetermined time; and cage number prediction means for predictively calculating the presence and absence and the number of the cages at predetermined floors or in predetermined floor zones after the lapse of the predetermined time, on the basis of the predicted cage positions and the predicted cage directions;

said assignment means including:

(a) tentative assignment means for tentatively assigning each cage to a hall call, predictively calculating the positions and directions of the respective cages after the lapse of the predetermined time with said cage position prediction means, and predictively calculating the respective cage numbers in the predetermined floor zones after the lapse of the predetermined time with said cage number prediction means, (b) assigned cage selection means for selecting a regularly assigned cage on the basis of the outputs of said tentative assignment means, and (c) assignment limitation means for outputting a command by which, depending upon the predicted number of cages in the predetermined floor zones, the tentatively assigned cages corresponding to a hall call are limited to the regularly assigned cages.

3. A group-supervisory apparatus for an elevator system according to claim 2, wherein:

said assignment means comprises wait time estimation means for calculating a wait time estimation value of a hall call in accordance with the predicted wait time of the hall call;

said assignment limitation means calculates an assignment limitation estimation value related to the number of cages in each predetermined floor zone in accordance with the calculation performed by said cage number prediction means;

said assigned cage selection means calculates an overall estimation value by adding the evaluation values of said wait time estimation means and said assignment limitation means; and the hall call is assigned to a cage according to the overall estimation value.

4. A group-supervisory elevator system comprising:

hall call registration means for registering hall calls when hall buttons are depressed;

assignment means for selecting a cage from among a plurality of cages and assigning the selected cage to a hall call;

cage control means for controlling a traveling direction of each cage, starting and stopping each cage, and opening and closing a door of each cage, thereby causing the assigned cage to respond to a cage call and the corresponding hall call;

standby means for causing an assigned cage, after it has responded to all the corresponding calls, to travel to and stand by at a predetermined floor;

cage position prediction means for predictively calculating cage positions and cage directions after the respective cages have successively responded to the cage calls and the correspondingly assigned hall calls after the lapse of a predetermined time; and cage number prediction means for predictively calculating the presence and absence and the number of the cages at predetermined floors or in predetermined floor zones after the lapse of the predetermined time, on the basis of the predicted cage positions and the predicted cage directions, wherein at least one of said assignment means, said cage control means and said standby means is actuated using the number of the cages predicted by said cage number prediction means.

5. A group-supervisory elevator system comprising:

hall call registration means for registering hall calls when hall buttons are depressed;

assignment means for selecting a cage from among a plurality of cages and assigning the selected cage to a hall call;

cage control means for controlling a traveling direction of each cage, starting and stopping each cage, and opening and closing a door of each cage, thereby causing the assigned cage to respond to a cage call and the corresponding hall call;

cage position prediction means for predictively calculating cage positions and cage directions after the respective cages have successively responded to the cage calls and the correspondingly assigned hall calls after the lapse of a predetermined time has lapsed; and cage number prediction means for predictively calculating the presence and absence and the number of the cages at predetermined floors or in predetermined floor zones after the lapse of the predetermined time, on the basis of the predicted cage positions and the predicted cage directions;

said assignment means including:

(a) tentative assignment means for tentatively assigning each cage to a hall call, predictively calculating the positions and directions of the respective cages after the lapse of the predetermined time with said cage position prediction means, and predictively calculating the respective cage numbers in the predetermined floor zones after the lapse of the predetermined time with said cage number prediction means, (b) assigned cage selection means for selecting a regularly assigned cage on the basis of the outputs of said tentative assignment means, and (c) assignment limitation means for outputting a command by which, depending upon the predicted number of cages in the predetermined floor zones, the tentatively assigned cages corresponding to a hall call are excluded from the cages to-be-assigned.

6. A method for assigning a new hall call to one of a plurality of elevator cages serving a plurality of floors comprising the steps of:

dividing the floors into a plurality of zones;

tentatively assigning the new hall call to each cage and, for each tentative assignment to each cage:

(a) calculating an arrival expectation time for each cage and for each floor based on a current position and motion of each cage and on hall calls and cage calls currently allocated to each cage, (b) calculating a predicted wait time for each currently allocated hall call and cage call by adding a continuation time elapsed since the hall or cage call was registered to the arrival expectation time for the floor designated by the hall call or cage call, (c) predicting a predicted cage position and a predicted cage direction for each cage after the lapse of a predetermined time based on the arrival expectation times, (d) calculating the number of cages which will be in each zone after the predetermined time has elapsed based on the predicted cage positions and the predicted cage directions, (e) calculating an assignment limitation estimation value based on the number of cages predicted to be in each zone after the predetermined time has elapsed, and (f) calculating a wait time estimation value based on the predicted wait times; and assigning the new hall call to one of the cages based on the assignment limitation estimation values and the wait time estimation values.

7. A method as recited in claim 6 wherein said step of tentatively assigning further includes, for each tentative assignment:

(g) setting a final call prediction hall to be a remotest one of the currently allocated hall calls and cage calls for each cage, and (h) calculating, for each cage, an unoccupied cage prediction time at which all currently allocated hall calls and cage calls will have been serviced, the unoccupied cage prediction time being the sum of the arrival expectation time at which the cage reaches the final call prediction hall and a stop time at the final call prediction hall.

8. A method as recited in claim 7 wherein, if the unoccupied cage prediction time is no more than the predetermined time, said step of predicting a predicted cage position includes predicting the cage position as being a floor corresponding to the final call prediction hall.

9. A method as recited in claim 7 wherein, if the unoccupied cage prediction time is greater than the predetermined time, said step of predicting a predicted cage position predicts the cage position as being a floor at which the arrival expectation time is the greatest arrival expectation time of all floors having currently allocated hall calls and cage calls that, added to the stop time, is less than or equal to the predetermined time.

10. A method as recited in claim 6 wherein said step of calculating an assignment limitation estimation value includes calculating a greater value as the cages are more prone to gather in one place.

11. A method as recited in claim 6 wherein said step of dividing includes dividing the floors into a first plurality of zones for upward movement of the cages including an uppermost and a lowermost upward moving zone, and into a second plurality of zones for downward movement including an uppermost and a lowermost downward moving zone.

12. A method as recited in claim 11 wherein said step of calculating an assignment limitation estimation value includes calculating a first value if four cages concentrate in one zone, a second value less than the first value if three cages concentrate in one zone, the second value if four cages concentrate in the uppermost upward and downward zones, the second value if four cages concentrate in the lowermost upward and downward zones, a third value less than the second value if three cages concentrate in the uppermost upward and downward zones, the third value if three cages concentrate in the lowermost upward and downward zones, and the third value if three adjacent zones all have zero cages.

13. A method as recited in claim 11 wherein said step of calculating an assignment limitation estimation value includes calculating a fourth value if fewer than two cages concentrate at the main floor and a fifth value less than the fourth value if at least two cages concentrate at the main floor.

14. A method as recited in claim 6 wherein said step of calculating a wait time estimation value includes adding squares of the predicted wait times.

15. A method as recited in claim 6 wherein said step of calculating a wait time estimation value includes adding the predicted wait times.

16. A method as recited in claim 6 wherein said step of calculating a wait time estimation value includes selecting a maximum of the predicted wait times.

17. A method according to claim 6 wherein said step of assigning includes calculating an overall estimation value for each tentative assignment by multiplying the assignment limitation estimation value by a scaling factor to produce a scaled assignment limitation estimation value and adding the wait time estimation value to the scaled assignment limitation estimation value to produce the overall estimation value.

18. A method as recited in claim 17 wherein said step of assigning includes assigning the new hall call to the cage for which the overall estimation value is the smallest.

* * * * *